US010844879B2

(12) United States Patent
Ueda

(10) Patent No.: US 10,844,879 B2
(45) Date of Patent: Nov. 24, 2020

(54) HYDRAULIC DRIVE DEVICE FOR CARGO VEHICLE

(71) Applicant: KABUSHIKI KAISHA TOYOTA JIDOSHOKKI, Kariya (JP)

(72) Inventor: Yuki Ueda, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 16/461,191

(22) PCT Filed: Oct. 20, 2017

(86) PCT No.: PCT/JP2017/037976
§ 371 (c)(1),
(2) Date: May 15, 2019

(87) PCT Pub. No.: WO2018/092507
PCT Pub. Date: May 24, 2018

(65) Prior Publication Data

US 2020/0063761 A1 Feb. 27, 2020

(30) Foreign Application Priority Data

Nov. 16, 2016 (JP) ..... 2016-223440

(51) Int. Cl.
*F15B 11/044* (2006.01)
*F15B 13/01* (2006.01)
(Continued)

(52) U.S. Cl.
CPC ..... *F15B 11/044* (2013.01); *B66F 9/22* (2013.01); *F15B 11/003* (2013.01); *F15B 13/01* (2013.01);
(Continued)

(58) Field of Classification Search
CPC ..... B66F 9/22; F15B 11/044; F15B 11/003; F15B 13/01; F15B 13/015;
(Continued)

(56) References Cited

U.S. PATENT DOCUMENTS 9,469,515 B2 * 10/2016 Matsuo ..... B66F 9/22
9,771,250 B2 * 9/2017 Ueda ..... B66F 9/22
2015/0013324 A1 1/2015 Matsuo et al.

FOREIGN PATENT DOCUMENTS

DE 102014105127 A1 10/2015
JP 2004-204974 A 7/2004
JP 2013-159431 A 8/2013

OTHER PUBLICATIONS

Communication dated May 15, 2020, from the European Patent Office in application No. 17870898.8.

* cited by examiner

*Primary Examiner* — Abiy Teka
*Assistant Examiner* — Michael Quandt
(74) *Attorney, Agent, or Firm* — Sughrue Mion, PLLC

(57) ABSTRACT

A hydraulic drive device for a cargo vehicle includes a hydraulic cylinder supplying and discharging of hydraulic oil, an operation member that operates the hydraulic cylinder, a hydraulic pump, a lowering oil path connecting the hydraulic cylinder and the hydraulic pump, an operation valve disposed in the lowering oil path, a bypass oil path that branches off from the lowering oil path, a bypass flow rate control valve disposed in the bypass oil path and that controls a bypass flow rate, and a resistance element that is disposed closer to the hydraulic cylinder than the operation valve in the lowering oil path and that increases a fluid resistance. A pilot flow path of the bypass flow rate control valve is connected to a part of the lowering oil path between the hydraulic cylinder and the resistance element.

1 Claim, 10 Drawing Sheets

(51) Int. Cl.
*F15B 11/00* (2006.01)
*B66F 9/22* (2006.01)

(52) U.S. Cl.
CPC ..... *F15B 2211/20515* (2013.01); *F15B 2211/20538* (2013.01); *F15B 2211/30515* (2013.01); *F15B 2211/3116* (2013.01); *F15B 2211/40507* (2013.01); *F15B 2211/40515* (2013.01); *F15B 2211/41581* (2013.01); *F15B 2211/46* (2013.01); *F15B 2211/7052* (2013.01); *F15B 2211/761* (2013.01)

(58) Field of Classification Search
CPC ..... F15B 2211/30515; F15B 2211/353; F15B 2211/46; F15B 2211/50545; F15B 2211/715
See application file for complete search history.

HYDRAULIC DRIVE DEVICE FOR CARGO VEHICLE

CROSS-REFERENCE TO RELATED APPLICATIONS

This application is a National Stage of International Application No. PCT/JP2017/037976 filed Oct. 20, 2017, claiming priority based on Japanese Patent Application No. 2016-223440 filed Nov. 16, 2016, the contents of all of which are incorporated herein by reference in their entirety.

TECHNICAL FIELD

The present invention relates to a hydraulic drive device for a cargo vehicle.

BACKGROUND ART

As a hydraulic drive device of a cargo vehicle, for example, a device described in Patent Document 1 is known. The hydraulic drive device disclosed in Patent Document 1 includes a hydraulic cylinder for raising and lowering that raises and lowers an object to be raised and lowered by supplying and discharging hydraulic oil, a raising and lowering operation member that operates hydraulic cylinder for raising and lowering, a hydraulic pump that supplies and discharges hydraulic oil to and from the hydraulic cylinder for raising and lowering, a motor that drives the hydraulic pump, an operation valve that is disposed between the suction port of the hydraulic pump and the bottom chamber of the raising and lowering hydraulic cylinder and that controls the flow of hydraulic oil based on the operation amount of the lowering operation of the operation member for raising and lowering.

CITATION LIST

Patent Document

Patent Document 1: Japanese Patent Application Publication No. 2004-204974

SUMMARY OF THE INVENTION

Problem that the Inventor is to Solve

Here, the above-described conventional hydraulic drive device has the following problems. That is, there is a case where a bypass oil path is provided in which a hydraulic oil flowing from a hydraulic cylinder branches off from an oil path leading to a hydraulic pump to a tank, where the operation of the bypass flow rate control valve provided in the bypass oil path may become unstable due to the influence of disturbance caused by fluid force, foreign matter, and the like. In order to reduce the influence of the disturbance, it is conceivable to increase the pressure loss of the operation valve and to increase the pilot pressure of the bypass flow rate control valve, but in this case, the energy recovery efficiency decreases.

An object of the present invention is to provide a hydraulic drive device for a cargo vehicle which has a high energy recovery efficiency and may stabilize the flow rate control characteristic of the hydraulic oil.

Solution to Problems

A hydraulic drive device for a cargo vehicle according to an aspect of the present invention includes a hydraulic cylinder for raising and lowering that raises and lowers an object to be raised and lowered by supplying and discharging of hydraulic oil, an operation member that operates the hydraulic cylinder, a hydraulic pump that supplies and discharges the hydraulic oil to and from the hydraulic cylinder, a lowering oil path connecting a bottom chamber of the hydraulic cylinder and a suction port of the hydraulic pump so that hydraulic oil discharged from the hydraulic cylinder flows to the suction port of the hydraulic pump, an operation valve that is disposed in the lowering oil path and that controls a flow of hydraulic oil discharged from the hydraulic cylinder based on a lowering operation of the operation member, a bypass oil path that branches off from the lowering oil path at a branch point and that connects the branch point and a tank that stores the hydraulic oil, a bypass flow rate control valve that is disposed in the bypass oil path and that controls a bypass flow rate which is a flow rate of hydraulic oil flowing from the branch point to the tank, and a resistance element that is disposed closer to the hydraulic cylinder than the operation valve in the lowering oil path and that increases a fluid resistance, wherein a pilot flow path of the bypass flow rate control valve is connected between the pilot check valve and the resistance element in the lowering oil path.

The hydraulic drive device for the cargo vehicle according to the present invention device includes the resistance element disposed closer to the hydraulic cylinder than the operation valve in the lowering oil path and increasing the fluid resistance. In addition, the pilot flow path of the bypass flow rate control valve is connected between the hydraulic cylinder and the resistance element in the lowering oil path. According to this configuration, the pressure loss generated in the resistance element may be added to the pilot pressure of the bypass flow rate control valve. As compared with the case where the pilot pressure is provided by the pressure loss at the operation valve, the pilot pressure may be increased by the addition of the pressure loss of the resistance element. By increasing the pilot pressure in this manner, the influence of the disturbance, which makes the operation of the bypass flow rate control valve unstable, may be reduced. Accordingly, the flow rate control characteristic of the hydraulic oil may be stabilized. The energy recovery efficiency decreases if reducing the influence of the disturbance is only dealt with increasing the pressure loss of the operation valve in order to, but the energy recovery efficiency may be improved by using the pressure loss of the resistance element because the pressure loss of the operation valve need not be increased or may be reduced by the use of the pressure loss of the resistance element. Accordingly, the great energy recovery efficiency is achieved, and the flow rate control characteristic of the hydraulic oil may be stabilized.

The hydraulic drive device for the cargo vehicle according to another aspect of the present invention may further include a pilot check valve for preventing natural fall, the pilot check valve being disposed between the hydraulic cylinder and the operation valve in the lowering oil path, wherein the resistance element may be disposed between the pilot check valve and the operation valve, and a merging position of a pilot flow path of the pilot check valve with the lowering oil path may be closer to the operation valve than the resistance element. This configuration permits reducing the pressure loss at the plunger of the pilot check valve by the influence of the pressure loss of the resistance element. Therefore, by adjusting the pressure loss of the resistance element, the total value of pressure losses generated by the pilot check valve 81 and the resistance element may be reduced. This permits improving energy recovery efficiency.

Further, the resistance element may be commonly used for obtaining such an effect and or increasing the pilot pressure of the bypass flow rate control valve.

Advantageous Effects of Invention

According to the present invention, the great energy recovery efficiency is achieved and the flow rate control characteristic of the hydraulic oil may be stabilized.

DESCRIPTION OF EMBODIMENTS

Figure 1:
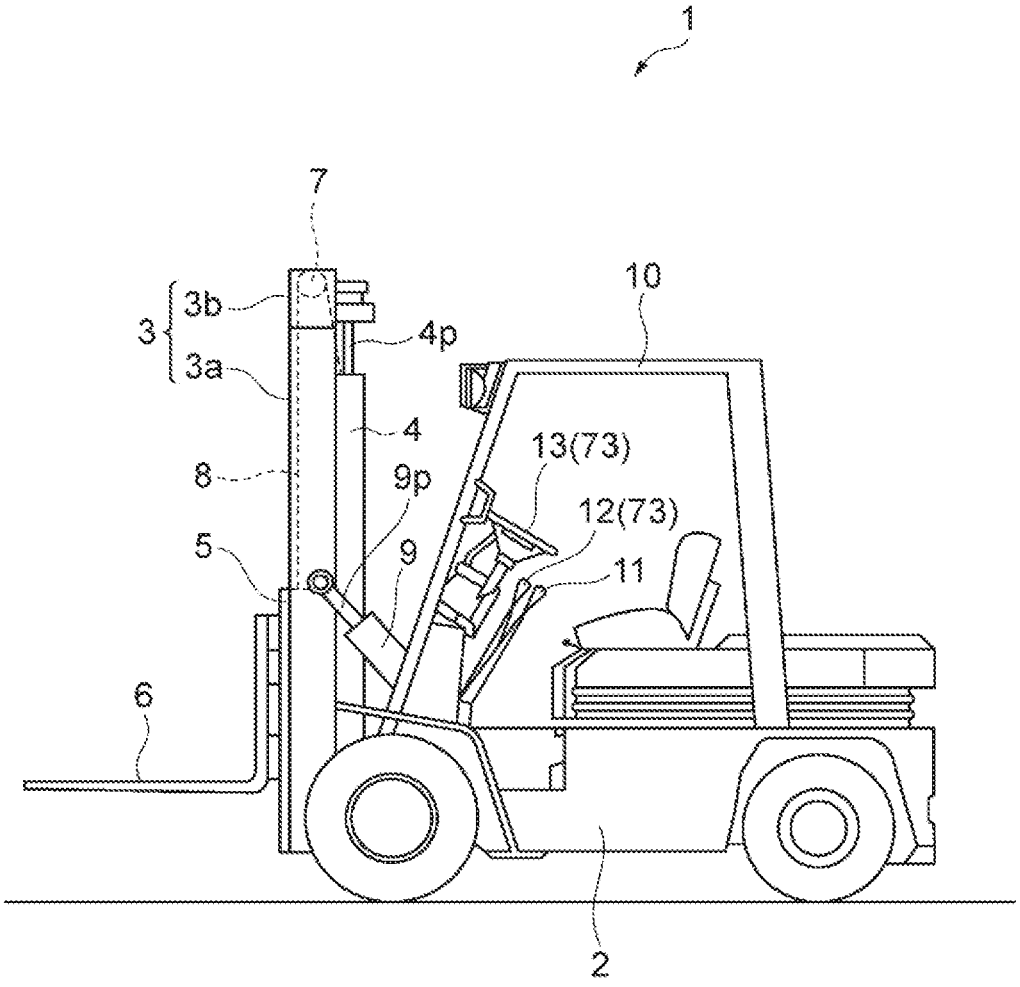
FIG. 1 is a side view showing a cargo vehicle including a hydraulic drive device according to an embodiment of the present invention.

Hereinafter, a preferred embodiment of a hydraulic drive device for a cargo vehicle according to the present invention will be described in detail with reference to the drawings. In the drawings, the same or equivalent elements are denoted by the same reference numerals, and redundant description is omitted.

FIG. 1 is a side view showing a cargo vehicle including a hydraulic drive device according to an embodiment of the present invention. In the figure, a cargo vehicle 1 according to the present embodiment is a battery-operated forklift. The cargo vehicle 1 includes a vehicle body frame 2 and a mast 3 disposed at the front portion of the vehicle body frame 2. The mast 3 includes a pair of right and left outer masts 3*a* tiltably supported by the vehicle body frame 2 and inner masts 3*b* arranged inward of the outer masts 3*a* and capable of moving up and down with respect to the outer masts 3*a*.

A lift cylinder 4 as a hydraulic cylinder for raising-and-lowering is disposed behind the mast 3. The tip portion of a piston rod 4*p* of the lift cylinder 4 is connected to the upper portion of the inner mast 3*b*.

A lift bracket 5 is supported on the inner mast 3*b* so as to be raised and lowered. A fork (object to be raised and lowered) 6 for loading a load is attached to the lift bracket 5. A chain wheel 7 is provided on the upper portion of the inner mast 3*b*, and a chain 8 is hung on the chain wheel 7. One end portion of the chain 8 is connected to the lift cylinder 4, and the other end portion of the chain 8 is connected to the lift bracket 5. With the expansion and the contraction of the lift cylinder 4, the fork 6 is raised and lowered together with the lift bracket 5 through the chain 8.

Tilt cylinders 9 as tilting hydraulic cylinders are supported on the left and right sides of the vehicle body frame 2, respectively. The tip portion of a piston rod 9*p* of the tilt cylinder 9 is rotatably connected to a substantially central portion of the outer mast 3*a* in the height direction thereof. The mast 3 tilts with the expansion and the contraction of the tilt cylinder 9.

An operator cabin 10 is provided on the upper portion of the vehicle body frame 2. A lift operation lever (first operation member) 11 for operating the lift cylinder 4 to raise and lower the fork 6 and an tilt operation lever 12 for operating the tilt cylinder 9 to tilt the mast 3 are provided in the front portion of the operator cabin 10.

Additionally, a steering wheel 13 for steering is provided in the front portion of the operator cabin 10. The steering wheel 13 is of a hydraulic power steering, and configured to assist the steering by the driver by a PS cylinder 14 (see FIG. 2) as a power steering (PS) hydraulic cylinder.

Further, the cargo vehicle 1 is provided with an attachment cylinder 15 (see FIG. 2) as an attachment hydraulic cylinder for operating attachments (not shown). The attachments include attachments for moving the fork 6 to the left and right, or tilting or rotating the fork 6. An attachment operation lever (not shown) for operating the attachment by operating the attachment cylinder 15 is provided in the operator cabin 10.

Further, though not specifically shown in the illustration, a direction switch for switching the traveling direction (forward/backward/neutral) of the cargo vehicle 1 is provided in the operator cabin 10.

Figure 2:
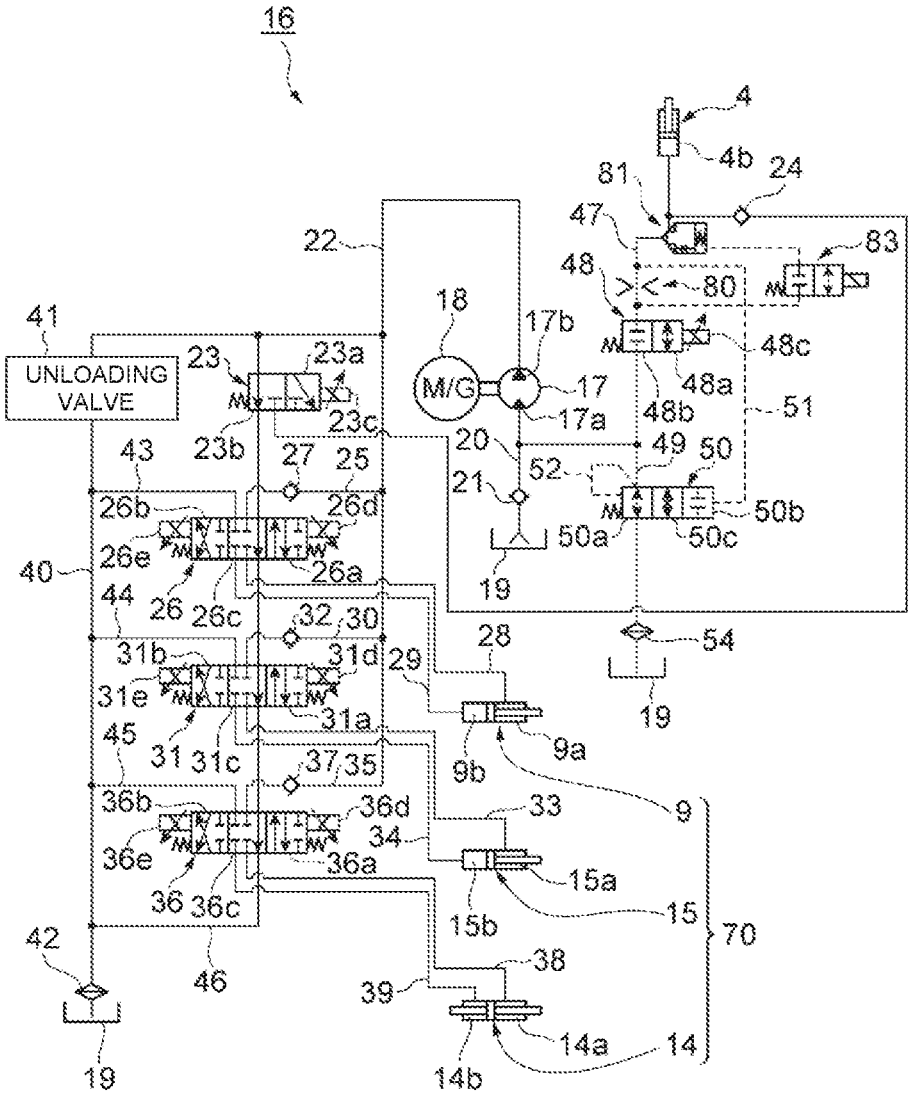
FIG. 2 is a hydraulic circuit diagram showing a hydraulic drive device according to an embodiment of the present invention.

FIG. 2 is a hydraulic circuit diagram showing a first embodiment of the hydraulic drive device according to the present invention. In the figure, a hydraulic drive device 16 of the present embodiment is a device that drives the lift cylinder 4, the tilt cylinder 9, the attachment cylinder 15 and the PS cylinder 14.

The hydraulic drive device 16 includes a single hydraulic pump motor 17 and a single electric motor 18 that is connected to the hydraulic pump motor 17 and drives the hydraulic pump motor 17. The hydraulic pump motor 17 has a suction port 17*a* for drawing hydraulic oil and a discharge port 17*b* for discharging hydraulic oil. The hydraulic pump motor 17 is configured to rotate in one direction.

The electric motor 18 functions as a motor and a generator. More specifically, when the hydraulic pump motor 17 operates as a hydraulic pump, the electric motor 18 functions as a motor, and when the hydraulic pump motor 17 operates as a hydraulic motor, the electric motor 18 functions as a generator. When the electric motor 18 functions as a generator, electric power generated by the electric motor 18 is stored in a battery (not shown). That is, the regeneration operation is performed.

A tank 19 configured to store hydraulic oil is connected to the suction port 17*a* of the hydraulic pump motor 17 through a hydraulic pipe 20. The hydraulic pipe 20 is provided with a check valve 21 that allows hydraulic oil to flow only in a direction from the tank 19 to the hydraulic pump motor 17. The hydraulic pump motor 17 functions as a pump that supplies hydraulic oil to the lift cylinder 4 during the raising operation by the lift operation lever 11, and functions as a hydraulic motor driven by the hydraulic oil discharged from the lift cylinder 4 during the lowering operation by the lift operation lever 11.

The discharge port 17*b* of the hydraulic pump motor 17 and a bottom chamber 4*b* of the lift cylinder 4 are connected through a hydraulic pipe 22. An electromagnetic proportional valve 23 for raising lift is disposed in the hydraulic pipe 22. The electromagnetic proportional valve 23 is switched between an open position 23*a* that allows the flow of the hydraulic oil from the hydraulic pump motor 17 to the bottom chamber 4*b* of the lift cylinder 4 and a closed position 23*b* that shuts off the flow of the hydraulic oil from the hydraulic pump motor 17 to the bottom chamber 4*b* of the lift cylinder 4.

The electromagnetic proportional valve 23 is normally in the closed position 23*b* (shown), and is switched to the open position 23*a* when an operation signal (a lift raising solenoid current command value corresponding to the operation amount of the raising operation of the lift operation lever 11) is input to a solenoid operation unit 23*c*. Thus, hydraulic oil is supplied from the hydraulic pump motor 17 to the bottom chamber 4*b* of the lift cylinder 4, the lift cylinder 4 is expanded, and the fork 6 is raised accordingly. It is noted that the electromagnetic proportional valve 23 opens with an opening in accordance with the operation signal when the electromagnetic proportional valve 23 is in the open position 23*a*. A check valve 24, which allows hydraulic oil to flow only in the direction from the electromagnetic proportional valve 23 to the lift cylinder 4, is provided between the electromagnetic proportional valve 23 and the lift cylinder 4 in the hydraulic pipe 22.

An electromagnetic proportional valve 26 for tilting is connected to a branch point between the hydraulic pump motor 17 and the electromagnetic proportional valve 23 in the hydraulic pipe 22 through a hydraulic pipe 25. The hydraulic pipe 25 is provided with a check valve 27 that allows hydraulic oil to flow only in the direction from the hydraulic pump motor 17 to the electromagnetic proportional valve 26.

The electromagnetic proportional valve 26 is connected to a rod chamber 9*a* and a bottom chamber 9*b* of the tilt cylinder 9 through hydraulic pipes 28 and 29, respectively. The electromagnetic proportional valve 26 is switched between an open position 26*a* that allows the flow of the hydraulic oil from the hydraulic pump motor 17 to the rod chamber 9*a* of the tilt cylinder 9, an open position 26*b* that allows the flow of the hydraulic oil from the hydraulic pump motor 17 to the bottom chamber 9*b* of the tilt cylinder 9, and a closed position 26*c* that shuts off the flow of the hydraulic oil from the hydraulic pump motor 17 to the tilt cylinder 9.

The electromagnetic proportional valve 26 is normally in the closed position 26*c* (shown), and is switched to the open position 26*a* when an operation signal (a tilt solenoid current command value corresponding to the operation amount of the rearward tilt operation of the tilt operation lever 12) is input to a solenoid operation unit 26*d* on the open position 26*a* side and is switched to the open position 26*b* when an operation signal (a tilt solenoid current command value in accordance with the operation amount of the forward tilt operation of the tilt operation lever 12) is input to a solenoid operation unit 26*e* on the open position 26*b* side. When the electromagnetic proportional valve 26 is switched to the open position 26*a*, hydraulic oil is supplied from the hydraulic pump motor 17 to the rod chamber 9*a* of the tilt cylinder 9, the tilt cylinder 9 is contracted, and the mast 3 tilts backward accordingly. When the electromagnetic proportional valve 26 is switched to the open position 26*b*, hydraulic oil is supplied from the hydraulic pump motor 17 to the bottom chamber 9*b* of the tilt cylinder 9, the tilt cylinder 9 is expanded, and the mast 3 tilts forward accordingly. When the electromagnetic proportional valve 26 is in the open position 26*a*, 26*b*, the electromagnetic proportional valve 26 opens with an opening in accordance with the operation signal.

An electromagnetic proportional valve 31 for attachments is connected upstream of the check valve 27 in the hydraulic pipe 25 through a hydraulic pipe 30. The hydraulic pipe 30 is provided with a check valve 32 that allows hydraulic oil to flow only in the direction from the hydraulic pump motor 17 to the electromagnetic proportional valve 31.

The electromagnetic proportional valve 31 is connected to a rod chamber 15*a* and a bottom chamber 15*b* of the attachment cylinder 15 through hydraulic pipes 33 and 34, respectively. The electromagnetic proportional valve 31 is switched between an open position 31*a* that allows the flow of the hydraulic oil from the hydraulic pump motor 17 to the rod chamber 15*a* of the attachment cylinder 15, an open position 31*b* that allows the flow of the hydraulic oil from the hydraulic pump motor 17 to the bottom chamber 15*b* of the attachment cylinder 15, and a closed position 31*c* that shuts off the flow of the hydraulic oil from the hydraulic pump motor 17 to the attachment cylinder 15.

The electromagnetic proportional valve 31 is normally in the closed position 31*c* (shown), and is switched to the open position 31*a* when an operation signal (an attachment solenoid current command value corresponding to the operation amount of the attachment operation lever to one side) is input to a solenoid operation unit 31*d* on the open position 31*a* side and is switched to the open position 31*b* when an operation signal (an attachment solenoid current command value in accordance with the operation amount of the attachment operation lever to the other side) is input to a solenoid operation unit 31*e* on the open position 31*b* side. It is noted that the description of the operation of the attachment cylinder 15 will be omitted. When the electromagnetic proportional valve 31 is in the open position 31*a*, 31*b*, the electromagnetic proportional valve 31 opens with an opening in accordance with the operation signal.

An electromagnetic proportional valve 36 for PS is connected to upstream of the check valve 32 in the hydraulic pipe 30 via a hydraulic pipe 35. The hydraulic pipe 35 is provided with a check valve 37 that allows hydraulic oil to flow only in the direction from the hydraulic pump motor 17 to the electromagnetic proportional valve 36.

The electromagnetic proportional valve 36 is connected to a first rod chamber 14*a* and a second rod chamber 14*b* of the PS cylinder 14 through hydraulic pipes 38 and 39, respectively. The electromagnetic proportional valve 36 is switched between an open position 36*a* that allows the flow of the hydraulic oil from the hydraulic pump motor 17 to the first rod chamber 14*a* of the PS cylinder 14, an open position 36*b* that allows the flow of the hydraulic oil from the hydraulic pump motor 17 to the second rod chamber 14*b* of the PS cylinder 14, and a closed position 36*c* that shuts off the flow of the hydraulic oil from the hydraulic pump motor 17 to the PS cylinder 14.

The electromagnetic proportional valve 36 is normally in the closed position 36*c* (shown), and is switched to the open position 36*a* when an operation signal (a PS solenoid current command value corresponding to the operation speed of one of right and left side operations of the steering wheel 13) is input to a solenoid operation unit 36*d* on the open position 36*a* side and is switched to the open position 36*b* when an operation signal (a PS solenoid current command value corresponding to the operation speed of the other of right and left side operations of the steering wheel 13) is input to a solenoid operation unit 36*e* on the open position 36*b* side. It is noted that the description of the operation of the PS cylinder 14 will be omitted. When the electromagnetic proportional valve 36 is in the open positions 36*a*, 36*b*, the electromagnetic proportional valve 36 opens with an opening in accordance with the operation signal.

The branch point between the hydraulic pump motor 17 and the electromagnetic proportional valve 23 in the hydraulic pipe 22 is connected to the tank 19 through a hydraulic pipe 40. The hydraulic pipe 40 is provided with an unloading valve 41 and a filter 42. Further, the hydraulic pipe 40 is connected to the electromagnetic proportional valves 26, 31, and 36 through hydraulic pipes 43, 44, 45, respectively. Further, the electromagnetic proportional valves 23, 26, 31, 36 are connected to the hydraulic pipe 40 through a hydraulic pipe 46.

The suction port 17*a* of the hydraulic pump motor 17 and the bottom chamber 4*b* of the lift cylinder 4 are connected through a lowering oil path 47. When the lift operation lever 11 is operated independently for lowering (the independent lowering operation of the lift operation lever 11), the lowering oil path 47 connects the bottom chamber 4*b* of the lift cylinder 4 and the suction port 17*a* of the hydraulic pump motor 17 so that the hydraulic oil discharged from the lift cylinder 4 flows to the suction port 17*a* of the hydraulic pump motor 17. A lift lowering operation valve 48 is disposed in the lowering oil path 47. The operation valve 48 is switched between an open position 48*a* that allows the flow of the hydraulic oil from the bottom chamber 4*b* of the lift cylinder 4 to the suction port 17*a* of the hydraulic pump motor 17 and a closed position 48*b* that shuts off the flow of the hydraulic oil from the bottom chamber 4*b* of the lift cylinder 4 to the suction port 17*a* of the hydraulic pump motor 17.

The operation valve 48 is normally in the closed position 48*b* (shown), and is switched to the open position 48*a* when an operation signal (a lift lowering solenoid current command value corresponding to the operation amount of the lowering operation of the lift operation lever 11) is input to a solenoid operation unit 48*c*. Then, the fork 6 is lowered due to the weight of the fork 6, the lift cylinder 4 is thus contracted, and the hydraulic oil flows out from the bottom chamber 4*b* of the lift cylinder 4. When the operation valve 48 is in the open position 48*a*, the operation valve 48 opens with an opening in accordance with the operation signal. Thus, the operation valve 48 controls a flow of hydraulic oil discharged from the lift cylinder 4 based on the lowering operation of the lift cylinder 4.

The branch point between the hydraulic pump motor 17 and the operation valve 48 in the lowering oil path 47 is connected to the tank 19 through a hydraulic pipe (bypass oil path) 49. In other words, the hydraulic pipe 49 is branches off from the lowering oil path 47 at the branch point and connects between the branch point and the tank 19 that stores hydraulic oil. A bypass flow rate control valve 50 is disposed in the hydraulic pipe 49. The bypass flow rate control valve 50 is a flow rate control valve with a pressure compensating function. The hydraulic pipe 49 is provided with a filter 54.

The bypass flow rate control valve 50 is switched between an open position 50*a* that allows the flow of the hydraulic oil, a closed position 50*b* that shuts off the flow of the hydraulic oil, and a throttle position 50*c* that adjusts the flow rate of the hydraulic oil. A pilot operation unit of the bypass flow rate control valve 50 on the closed position 50*b* side is connected upstream (front side) of the operation valve 48 through a pilot flow path 51. The pilot operation unit of the bypass flow rate control valve 50 on the open position 50*a* side is connected downstream (rear side) of the operation valve 48 via a pilot flow path 52. The bypass flow rate control valve 50 is opened with an opening in accordance with the pressure difference between the front and the rear of the operation valve 48. Specifically, the greater the pressure difference between the front and the rear of the operation valve 48 is, the smaller the opening of the bypass flow rate control valve 50 becomes.

Of the above-described cylinders, the tilt cylinder 9, the attachment cylinder 15, and the PS cylinder 14, which perform operations different from the lift cylinder (first hydraulic cylinder) 4 by supplying and discharging of hydraulic oil, may be collectively referred to as a "second hydraulic cylinder 70". In addition, the tilt operation lever 12, the steering wheel 13, and the attachment operation lever, which are the levers for operating the second hydraulic cylinder 70, may be collectively referred to as a "second operation member 73."

Figure 3:
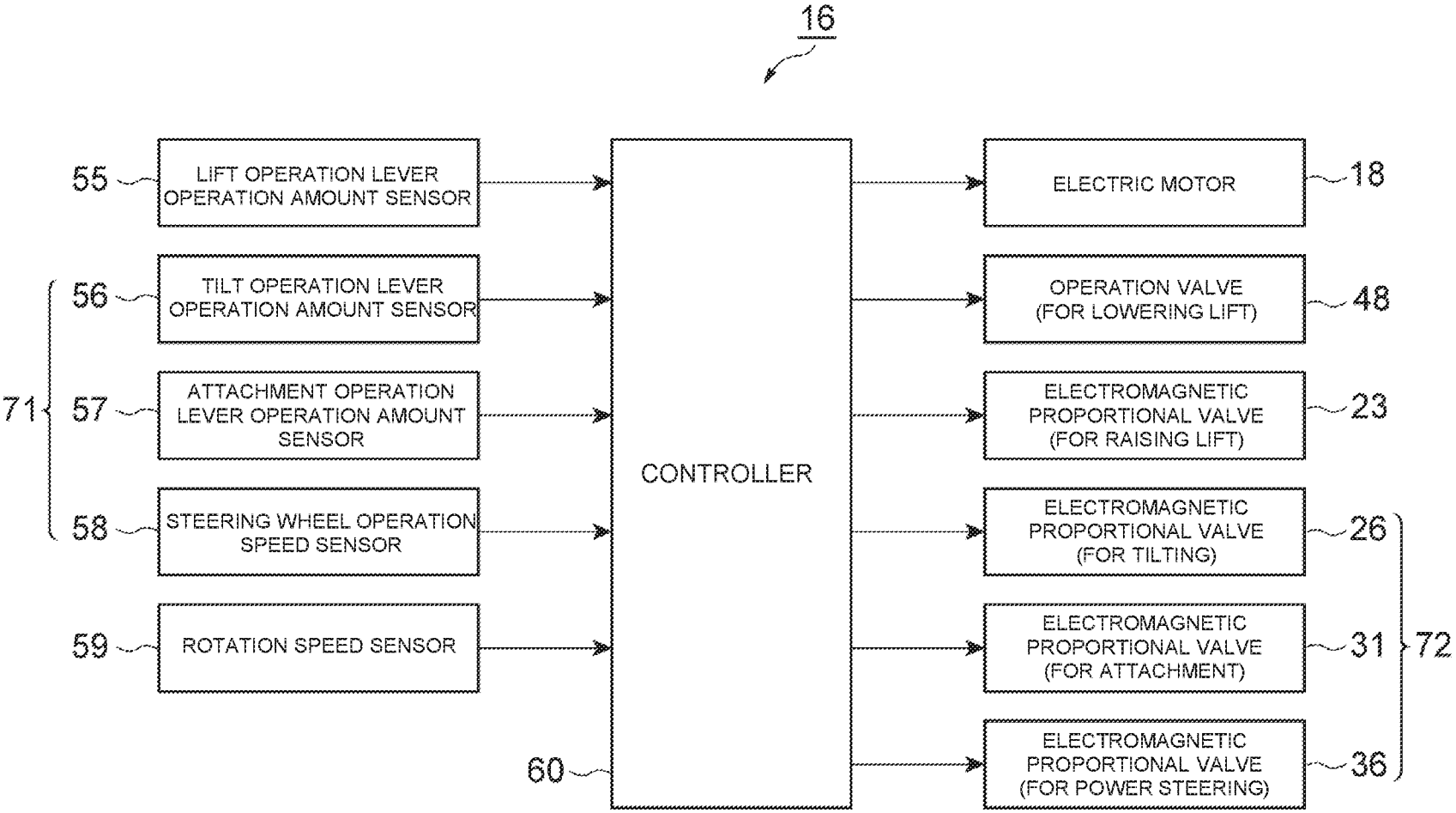
FIG. 3 is a configuration diagram showing a control system of the hydraulic drive device shown in FIG. 2.

FIG. 3 is a configuration diagram showing a control system of the hydraulic drive device 16. In the figure, the hydraulic drive device 16 includes a lift operation lever operation amount sensor (operation amount detection unit) 55 that detects the operation amount of the lift operation lever 11, a tilt operation lever operation amount sensor 56 that detects the operation amount of the tilt operation lever 12, an attachment operation lever operation amount sensor 57 that detects the operation amount of the attachment operation lever (not shown), a steering wheel operation speed sensor 58 that detects the operation speed of the steering wheel 13, a rotational speed sensor 59 that detects the actual rotational speed (actual motor rotational speed) of the electric motor 18, and a controller 60.

The controller 60 receives the detection values of the operation lever operation amount sensors 55, 56, 57, the steering wheel operation speed sensor 58, and the rotational speed sensor 59, performs a predetermined process, and controls the electric motor 18, the electromagnetic proportional valves 23, 26, 31, 36, and the operation valve 48. The sensors 56, 57, 58 that detect the operation amount of the second operation unit 73 may be referred to as a "second operation amount detection unit 71". Further, the electromagnetic proportional valves 26, 31, 36, which are disposed between the discharge port 17*b* of the hydraulic pump motor 17 and the second hydraulic cylinder and control the flow of the hydraulic oil based on the operation of the second operation unit 73, may be referred to as a "second operation valve 72".

Figure 4:
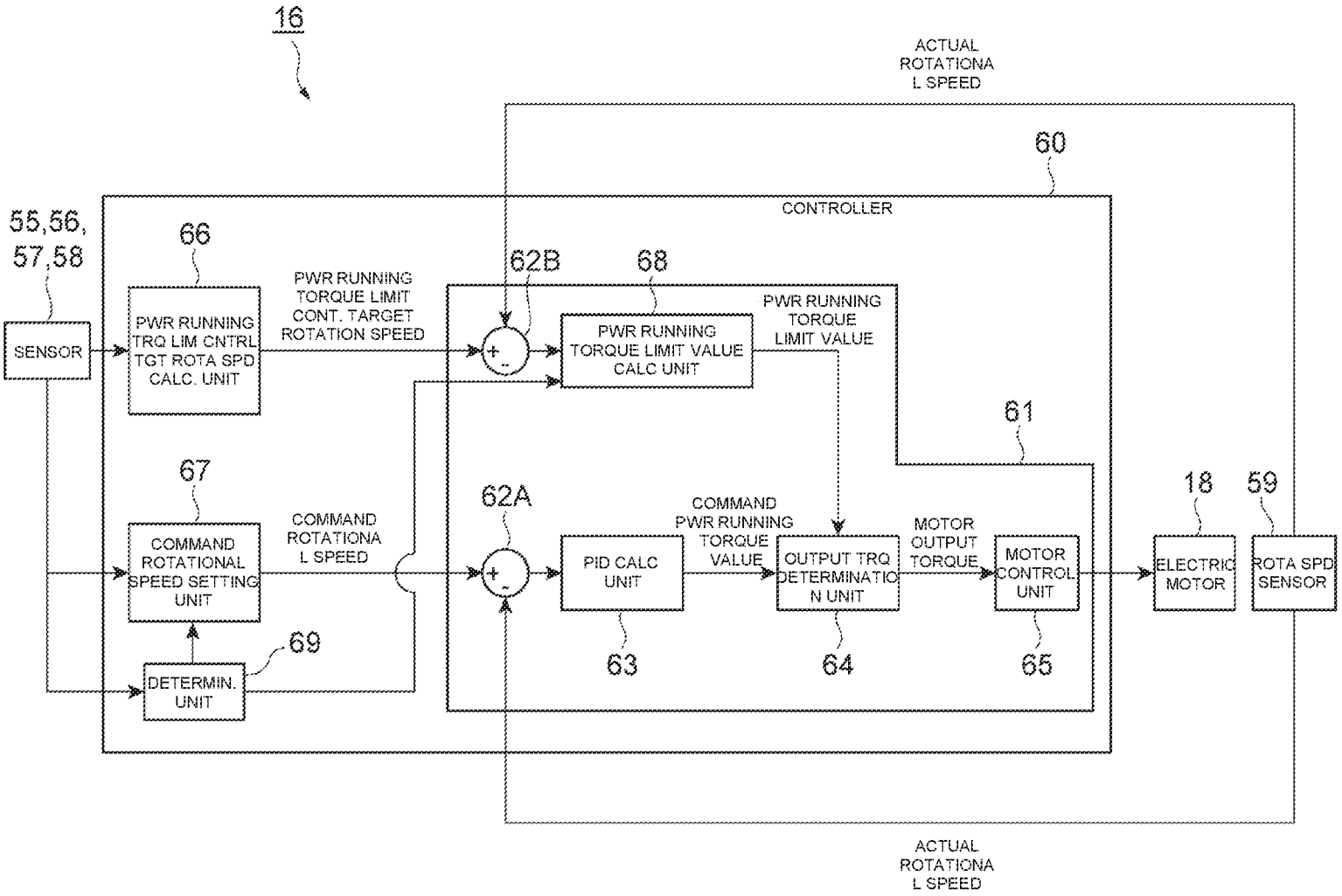
FIG. 4 is a block configuration diagram showing the control system of the hydraulic drive device shown in FIG. 2.

FIG. 4 is a block configuration diagram showing a block configuration of a control system of the hydraulic drive device 16. As shown in FIG. 4, the controller 60 includes a motor driver (electric motor control unit) 61, a power running torque limit control target rotational speed calculation unit 66, a command rotational speed setting unit 67, and a determination unit 69.

The motor driver 61 includes comparison units 62A and 62B, a PID calculation unit 63, a power running torque limit value calculation unit 68, an output torque determination unit 64, and a motor control unit 65. The comparison unit 62A calculates a rotational speed deviation between the command rotational speed set by the command rotational speed setting unit 67 and the actual motor rotational speed detected by the rotational speed sensor 59. The comparison unit 62B calculates a rotational speed deviation between the target rotational speed for the power running torque limit control set by the power running torque limit control target rotational speed calculation unit 66 and the actual motor rotational speed detected by the rotational speed sensor 59. The PID calculation unit 63 performs a PID calculation of the rotational speed deviation between the command rotational speed and the actual motor rotational speed to obtain a power running torque command value of the electric motor 18 so that the rotational speed deviation becomes zero. The PID calculation is a calculation in which proportional, integral and derivative actions are combined. The power running torque limit value calculation unit 68 calculates the power running torque limit value of the electric motor 18 based on the rotational speed deviation between the target rotational speed for the power running torque limit control and the actual motor rotational speed detected by the rotational speed sensor 59. The power running torque limit value is a value for limiting an increase in the output torque when the output torque of the electric motor 18 shifts toward the power running side. The power running torque limit value set by the power running torque limit value calculation unit 68 will be described later.

The output torque determination unit 64 and the motor control unit 65 control the electric motor 18 so as to achieve the rotational speed based on the command rotational speed and control the electric motor 18 so as to achieve the rotational speed based on the power running torque limit value when the output torque of the electric motor 18 shifts toward the power running side. The output torque determination unit 64 compares the power running torque command value (which is a value based on the command rotational speed) obtained by the PID calculation unit 63 with the power running torque limit value of the electric motor 18 set by the power running torque limit value calculation unit 68 to determine the output torque of the electric motor 18. Specifically, when the power running torque command value is equal to or less than the power running torque limit value, the power running torque command value is set as the output torque of the electric motor 18. When the power running torque command value is higher than the power running torque limit value, the power running torque limit value is set as the output torque of the electric motor 18. The motor control unit 65 converts the output torque determined by the output torque determination unit 64 into a current signal and transmits such signal to the electric motor 18. It is noted that the bypass flow rate control valve 50 discharges the hydraulic oil to the tank 19 through the hydraulic pipe 49 when driving the electric motor 18 based on the command rotational speed cannot be achieved because the electric motor 18 is controlled so as to drive at the rotational speed based on the power running torque limit value.

The command rotational speed setting unit 67 acquires the detection values detected by the sensors 55, 56, 57, 58, and sets the command rotational speed based on such detected values. The command rotational speed setting unit 67 sets the command rotational speed in accordance with the operation amounts of the operation levers. The command rotational speed set by the command rotational speed setting unit 67 will be described later. The power running torque limit control target rotational speed calculation unit 66 acquires the detection values detected by the sensors 55, 56, 57, 58, and sets the target rotational speed for the power running torque limit control based on such detection values. The power running torque limit control target rotational speed calculation unit 66 sets the target rotational speed for the power running torque limit control in accordance with the operational state of the operation levers.

The determination unit 69 determines whether the lowering operation of the lift operation lever 11 is performed independently and whether the lowering operation of the lift operation lever 11 and the operation of the second operation unit 73 are simultaneously performed. For example, the determination unit 69 determines that the lowering operation of the lift operation lever 11 and the operation of the second operation unit 73 is performed simultaneously when the lift lowering operation and the tilt operation are performed, when the lift lowering operation and the attachment operation are performed, when the lift lowering performed and the power steering operation are performed, and when the lift lowering operation and the tilt operation and the power steering operation are performed. The determination unit 69 outputs the determination results to the command rotational speed setting unit 67 and the power running torque limit value calculation unit 68.

The command rotational speed and the power running torque limitation will now be described. When it is determined by the determination unit 69 that the lowering operation of the lift operation lever 11 is performed independently, the command rotational speed setting unit 67 sets the required lowering rotational speed for the command rotational speed. The required lowering rotational speed is a rotational speed corresponding to the flow rate necessary for the lowering operation. When it is determined by the determination unit 69 that the lowering operation of the lift operation lever 11 is performed independently, the motor driver 61 performs power running torque limit control to place a limit for the power running torque output of the electric motor 18 in order to suppress the consumption of unnecessary electric power. In executing the power running torque limit control is performed, the power running torque limit control target rotational speed calculation unit 66 may set the preset minimum rotational speed as the target rotational speed for the power running torque limit control. This minimum rotational speed may be determined according to the specifications of the pump and the motor, and may be set at 0 rpm or a value close to 0 rpm.

When it is determined by the determination unit 69 that the lowering operation of the lift operation lever 11 and the operation of the second operation member 73 are performed simultaneously, the command rotational speed setting unit 67 sets one of values of the required lowering rotational speed and the required rotational speed of the second hydraulic cylinder that is greater than the other as the command rotational speed. Further, when it is determined by the determination unit 69 that the lowering operation of the lift operation lever 11 and the operation of the second operation member 73 are performed simultaneously, the motor driver 61 cancels the power running torque limit control and allows the power running. At this time, the power running torque limit value calculation unit 68 sets the rated power running torque for the power running torque limit value.

Figure 5:
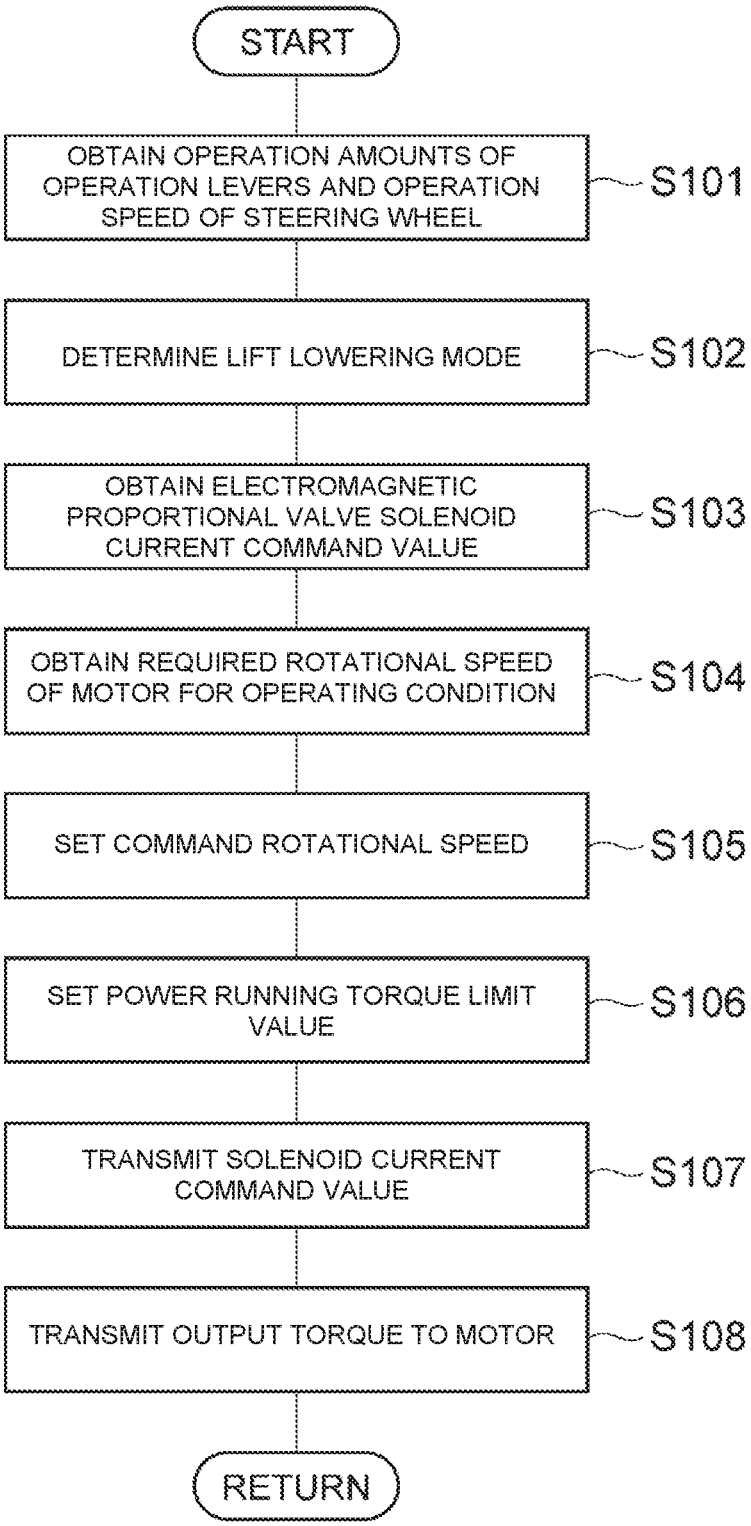
FIG. 5 is a flowchart showing a control processing procedure performed by a controller shown in FIG. 3.

FIG. 5 is a flowchart showing a control process performed by the controller 60. It is noted that only the operation including the lowering of the fork 6 (lift lowering) is subjected in this control process. Further, the cycle of executing this control process is appropriately determined by an experiment or the like.

Firstly, referring to FIG. 5, the operation amounts of the lift operation lever 11, the tilt operation lever 12 and the attachment operation lever detected by the operation lever operation amount sensors 55, 56, 57, and the operation speed of the steering wheel 13 detected by the steering wheel operation speed sensor 58 are obtained (Step S101).

Subsequently, based on the operation amounts of the lift operation lever 11, the tilt operation lever 12, the attachment operation lever, and the operation speed of the steering wheel 13 obtained at Step S101, the lift lowering mode as an operating condition is determined (Step S102). The lift lowering mode includes the independent lift lowering operation, the combination of the lift lowering operation and the tilt operation, the combination of the lift lowering and the attachment operation, the combination of the lift lowering and the power steering operation, and the combination of the lift lowering operation, the tilt operation and the power steering operation.

Then, an electromagnetic proportional valve solenoid current command value in accordance with the operation amounts of the lift operation lever 11, the tilt operation lever 12, and the attachment operation lever and the operation speed of the steering wheel 13 obtained at Step S101, the lift lowering mode determined in Step S102 is obtained (Step S103). The electromagnetic proportional valve solenoid current command value includes the lift lowering solenoid current command value in accordance with the operation amount of the lift operation lever 11 in the lowering operation, the tilt solenoid current command value corresponding to the operation amount of the tilt operation lever 12, the attachment solenoid current command value corresponding to the operation amount of the attachment operation lever, and the power steering (PS) solenoid current command value corresponding to the operation speed of the steering wheel 13.

Subsequently, the required rotational speed for the operating condition determined at Step S102 is obtained (Step S104). The required rotational speed includes a required lift motor rotational speed, a required tilt motor rotational speed, a required attachment motor rotational speed and a required power steering (PS) motor rotational speed. The required lift motor rotational speed is the rotational speed of the electric motor 18 necessary for performing the lift operation. The required tilt motor rotational speed is the rotational speed of the electric motor 18 necessary for performing the tilt operation. The required attachment motor rotational speed is the rotational speed of the electric motor 18 necessary for performing the attachment operation. The required PS motor rotational speed is the rotational speed of the electric motor 18 necessary for performing the PS operation.

Then, the command rotational speed setting unit 67 sets the command rotational speed based on the lift lowering mode determined at Step S102 and the required rotational speed determined at Step S104 (Step S105).

Subsequently, the power running torque limit value of the electric motor 18 is set based on the lift lowering mode determined at Step S102 (Step S106). The power running torque limit value is the allowable value for the power running torque.

After Step S106 is performed, the electromagnetic proportional valve solenoid current command value obtained at Step S103 is transmitted to the corresponding solenoid operation unit of the electromagnetic proportional valve (Step S107). At this time, the lift lowering solenoid current command value is transmitted to the solenoid operation unit 48*c* of the operation valve 48. Further, when the tilt solenoid current command value is obtained, the current command value is transmitted to any one of the solenoid operation units 26*d*, 26*e* of the electromagnetic proportional valve 26, when the attachment solenoid current command value is obtained, the current command value is transmitted to any one of the solenoid operation units 31*d*, 31*e* of the electromagnetic proportional valve 31, and when the PS solenoid current command value is obtained, the current command value is transmitted to any one of the solenoid operation units 36*d*, 36*e* of the electromagnetic proportional valve 36.

Subsequently, the output torque of the electric motor 18 is determined based on the command rotational speed set at Step S105, the actual motor rotational speed detected by the rotational speed sensor 59, and the power running torque limit value of the electric motor 18 set at Step S106, and such output torque is transmitted as a control signal to the electric motor 18 (Step S108), As shown in FIG. 4, the process of Step S108 is executed by the motor driver 61 included in the controller 60.

Figure 6:
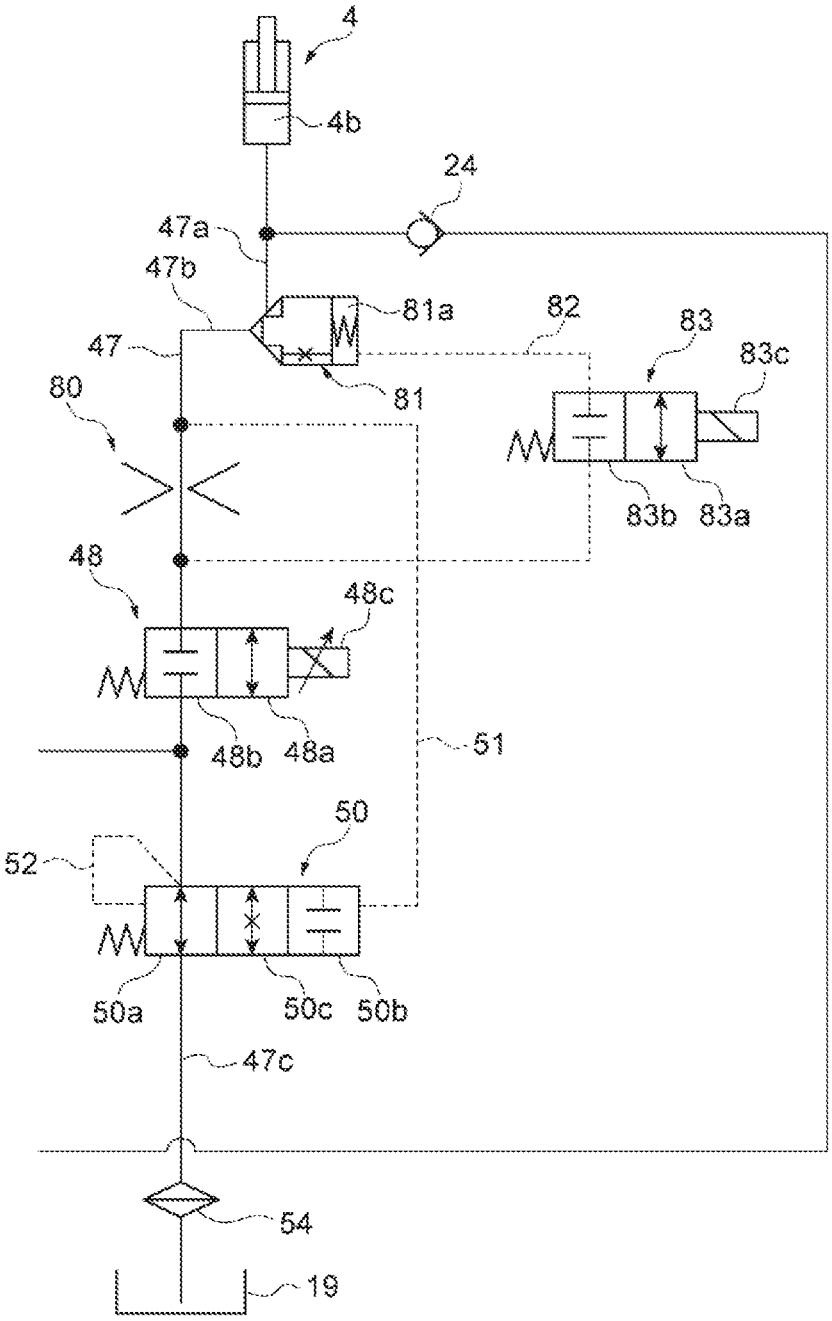
FIG. 6 is a configuration diagram detailing a configuration in the vicinity of a lowering oil path of a hydraulic drive device for a cargo vehicle.

FIG. 6 is a configuration diagram showing the configuration around the lowering oil path 47 of the hydraulic drive device 16 for the cargo vehicle 1. As described above, the operation valve 48 is disposed closer to the lift cylinder 4 than the branch point in the lowering oil path 47. The bypass flow rate control valve 50 is provided in the hydraulic pipe 49 that connects the branch point and the tank 19. A resistance element 80 is disposed closer to the lift cylinder 4 than the operation valve 48 in the lowering oil path 47. A pilot check valve 81 is disposed between the lift cylinder 4 and the operation valve 48 in the lowering oil path 47.

In the present embodiment, the pressure before and after the operation valve 48 is used as the pilot pressure of the bypass flow rate control valve 50. As described above, the opening of the operation valve 48 corresponds to the operation amount of the lift operation lever 11 by the operator. Therefore, the differential pressure generated by the operation valve 48 per flow rate of the hydraulic oil is a value corresponding to the operation amount of the lift operation lever 11, which becomes smaller as the lever operation amount becomes larger.

The resistance element 80 is a member that increases the fluid resistance at a position where the resistance element 80 is provided. In the present embodiment, the resistance element 80 is disposed between the operation valve 48 and the pilot check valve 81 in the lowering oil path 47. The configuration of the resistance element 80 is not particularly limited as long as the fluid resistance may be increased. For example, the resistance element 80 may be formed by an orifice, a choke, a contraction part or the like which reduces the cross-sectional area of the flow path.

The pilot check valve 81 is a valve for preventing natural fall of the lift cylinder 4. The pilot check valve 81 is provided between an oil path 47*a* of the lowering oil path 47 on the lift cylinder 4 side and an oil path 47*b* of the lowering oil path 47 on the operation valve 48 side. The pilot check valve 81 is connected to the lowering oil path at a position between the resistance element 80 and the operation valve 48 through a pilot flow path 82. A switching valve 83 is provided in the pilot flow path 82. When the lift cylinder 4 is raised, the pilot check valve 81 shuts off the flow of hydraulic oil from the oil path 47*a* on the lift cylinder 4 side to the oil path 47*b* on the operation valve side. When the lift cylinder 4 is lowered, the pilot check valve 81 allows the flow of hydraulic oil from the oil path 47*a* on the lift cylinder 4 side to the oil path 47*b* on the operation valve 48 side when the switching valve 83 is open. When the switching valve 83 is closed in order to prevent natural fall of the lift cylinder 4, on the other hand, the pilot check valve 81 shuts off the flow of hydraulic oil from the oil path 47*a* on the lift cylinder 4 side to the oil path 47*b* on the operation valve 48 side. The configuration in which the check valve 24 is omitted and the hydraulic oil supplied from the hydraulic pump motor 17 flows to the 47*b* may be employed. In this case, the pilot check valve 81 allows a flow from the oil path 47*b* on the operation valve 48 side to the oil path 47*a* side when the cylinder 4 is raised.

Specifically, the switching valve 83 is switched between an open position 83*a* that allows the flow of the hydraulic oil from a spring chamber 81*a* of the pilot check valve 81 to the operation valve 48, and a closed position 83*b* that shuts off the flow of the hydraulic oil from the spring chamber 81*a* to the operation valve 48. The switching valve 83 is normally in the closed position 83*b* (shown) and is switched to the open position 83*a* when an operation signal is input to a solenoid operation unit 83*c*.

Figure 7B:
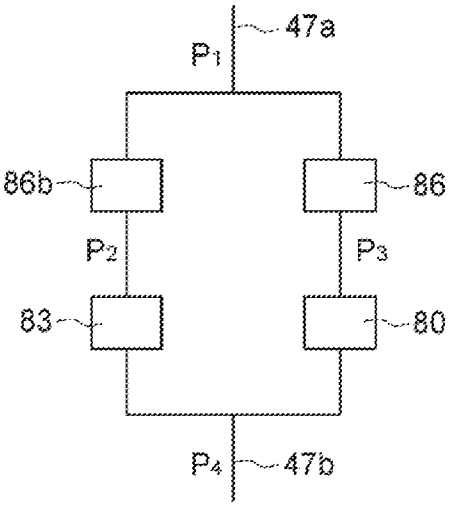
FIGS. 7A and 7B are cross-sectional views showing a detailed configuration around a pilot check valve.
Figure 7A:
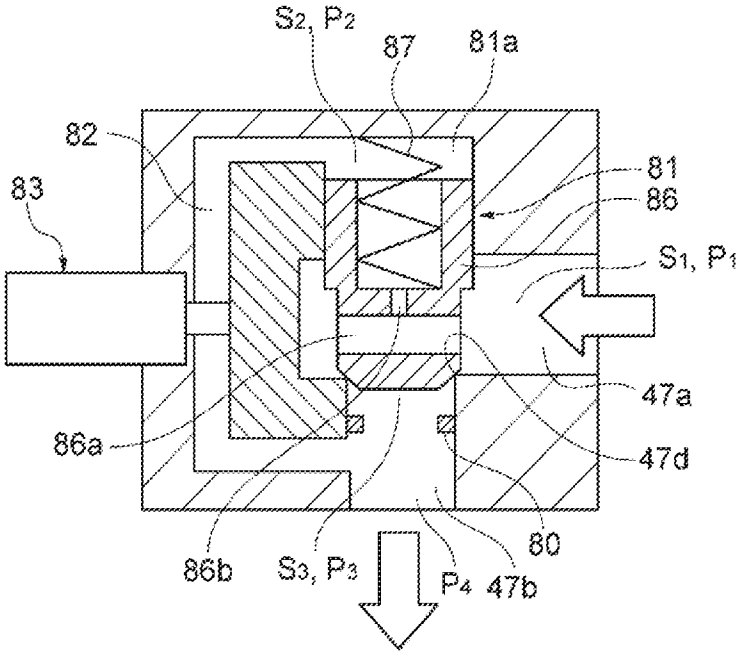

The following will described the detailed configuration of the pilot check valve 81 with reference to FIGS. 7A and 7B. FIG. 7A is a schematic sectional view showing the configuration of the pilot check valve 81 and its surroundings. As shown in FIG. 7A, the pilot check valve 81 includes a plunger 86 disposed between the oil path 47*a* and the oil path 47*b*, and a spring 87 disposed opposite the oil path 47*b* with the plunger 86 disposed between the spring 87 and the oil path 47*b*. The oil path 47*a* and the oil path 47*b* intersect at right angles, and the plunger 86 is disposed at a position where the oil path 47*a* and the oil path 47*b* intersect. In addition, the direction in which the plunger 86 moves is perpendicular to the direction in which the oil path 47*a* extends, and is in the same direction as the direction in which the oil path 47*b* extends. The spring chamber 81*a* in which the spring 87 is disposed is formed opposite from the oil path 47*b* with the plunger 86 disposed between the spring chamber 81*a* and the oil path 47*b*. The spring 87 is disposed so as to press the plunger 86 toward the oil path 47*b*. As a result, the plunger 86 is pressed to an inlet portion 47*d* of the oil path 47*b* to block between the oil path 47*a* and the oil path 47*b*. The plunger 86 has a flow path 86*a* communicating with the oil path 47*a* and a plunger orifice 86*b* penetrating from the flow path 86*a* into the spring chamber 81*a*. The plunger orifice 86*b* communicates the oil path 47*a* with the spring chamber 81*a*. Further, the spring chamber 81*a* and the oil path 47*b* are in communication through the pilot flow path 82. As described above, the pilot flow path 82 may be opened and closed by the switching valve 83. The resistance element 80 is provided at a position closer to the plunger 86 than a merging portion where the pilot flow path 82 merges with the oil path 47*b*.

According to the above-described configuration, when the switching valve 83 opens, hydraulic oil flows from the plunger orifice 86*b* through the pilot flow path 82, which press the plunger 86 upwardly. With the plunger 86 opened, hydraulic oil flows from the oil path 47*a* to the oil path 47*b*. At this time, the hydraulic oil passes through the resistance element 80. Therefore, a flow of hydraulic oil holds the relation shown in FIG. 7B. That is, the hydraulic oil flowing from the oil path 47*a* is branched off, one of which passes through the plunger 86 and the resistance element 80, and the other passes through the plunger orifice 86*b* and the switching valve 83, and merged in the oil path 47*b*.

Here, the pressure of the oil path 47*a* is defined as $P_1$, and its pressure receiving area is defined as $S_1$. The pressure in the spring chamber 81*a* is defined as $P_2$, and its pressure receiving area is defined as $S_2$. The pressure of the oil path 47*b* upstream of the resistance element 80 is defined as $P_3$, and its pressure receiving area is defined as $S_3$. The pressure downstream of the resistance element 80 is defined as $P_4$. The pressure receiving areas $S_1$ to $S_3$ will be described in the followings. In the case where the resistance element 80 is present, since the P2 is reduced, the force F pushing the plunger 86 upward increases. Therefore, the pressure loss generated when the hydraulic oil passes through the plunger 86 is reduced. At this time, the force F pushing up the plunger 86 may be expressed by Equation (1). On the other hand, when there is no resistance element 80, the force F pushing up the plunger 86 may be expressed by Equation (2).

$S_1$ . . . $S_2-S_3$ $S_2$ . . . Sectional area of the plunger on the spring chamber 81*a* side (plunger outer diameter ^ 2/4*π)

$S_3$ . . . Flow path sectional area of the inlet portion 47*d*

$$F=(P_1-P_4)(S_1+S_3\beta-S_2\alpha)-k(x+x_0) \quad \text{Equation (1)}$$

where, α: partial pressure ratio $(P_2-P_4)/(P_1-P_4)$

β: partial pressure ratio $(P_3-P_4)/(P_1-P_4)$ k: Spring constant of the spring 87 x: Deflection amount of the spring 87 $x_0$: Deflection amount of the spring 87 (initial value)

$$F=(P_1-P_4)(S_1-S_2\alpha)-k(x+x_0) \quad \text{Equation (2)}$$

where, α: partial pressure ratio $(P_2-P_4)/(P_1-P_4)$

As described above, increasing the pressure loss generated by the resistance element 80 (that is, increasing β), the force F opening the valve becomes large, which makes the pressure loss occurring in the plunger 86 small. The sum of "the pressure loss at the resistance element 80 and the pressure loss at the plunger 86" becomes the minimum value when the resistance element 80 is present. Therefore, the resistance element 80 may be set so that such sum becomes the minimum value.

Returning to FIG. 6, the pilot flow path 51 of the bypass flow rate control valve 50 is connected to part of the lowering oil path 47 between the pilot check valve 81 and the resistance element 80. That is, the pilot operation unit of the bypass flow rate control valve 50 on the closed position 50*b* side and the part of the lowering oil path 47 between the pilot check valve 81 and the resistance element 80 are connected through the pilot flow path 51. With such configuration, the pilot pressure may be increased by adding the pressure loss generated by the resistance element to the pilot pressure, that is, "the operation valve 48 and the differential pressure of the resistance element 80".

Figure 10:
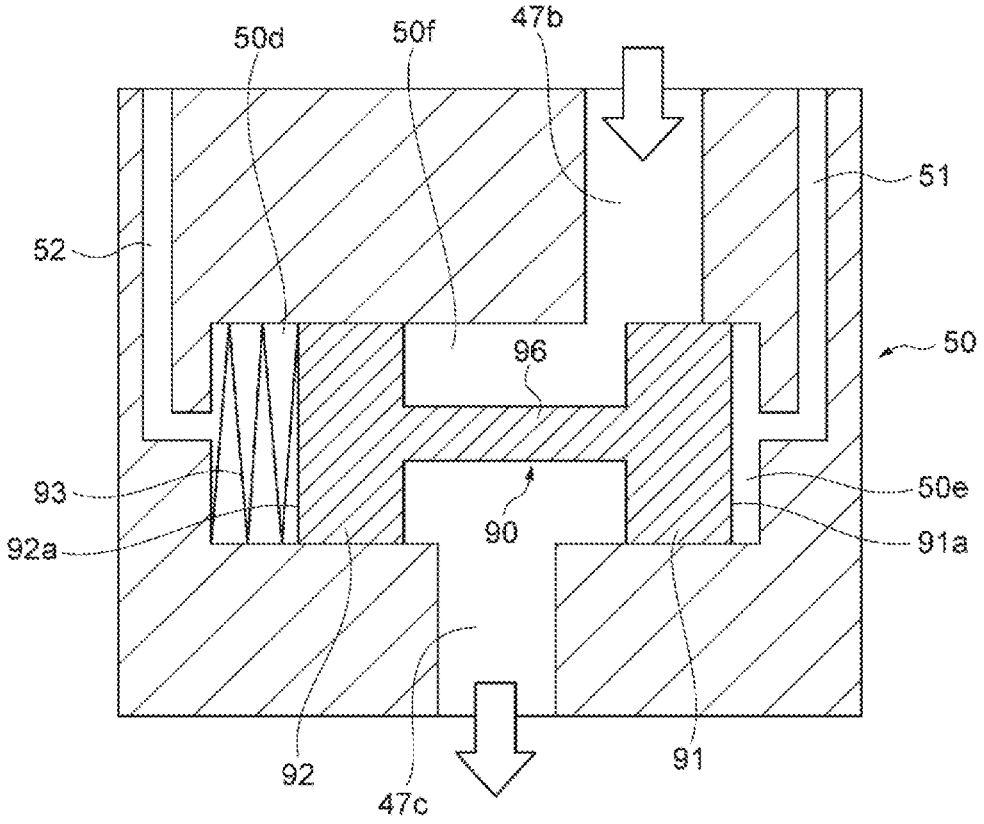
FIG. 10 is a cross-sectional view showing a detailed configuration of a bypass flow rate control valve.

FIG. 10 is a cross-sectional view showing the detailed configuration of the bypass flow rate control valve 50. As shown in FIG. 10, the bypass flow rate control valve 50 includes a spool 90 that is disposed in a stroke space 50*f* and reciprocally moves in such space, and a spring 93 that presses the spool 90. The spool 90 includes an enlarged diameter portion 91 that is provided at one end of the spool 90 and has a shape and size to close the stroke space 50*f*, an enlarged diameter portion 92 that is provided on the other end of the spool 90 and that has a shape and size to close the stroke space 50*f*, and a connection portion 96 that connects the enlarged diameter portions 91, and 92 and has a diameter smaller than those of the enlarged diameter portions 91, and 92. A pilot space 50*e* connected to the pilot flow path 51 is formed in the stroke space 50*f* at a position outward of the end of the enlarged diameter portion 91. It is noted that the end of the enlarged diameter portion 91 disposed in the pilot space 50*e* forms a pressure receiving surface 91*a*. A spring chamber 50*d* connected to the pilot flow path 52 and in which the spring 93 is disposed is formed in the stroke space 50*f* at a position outward of the end of the enlarged diameter portion 92. The end of the enlarged diameter portion 92 disposed in the spring chamber 50*d* forms a pressure receiving surface 92*a*.

The oil path 47*b* of the lowering oil path 47 on the operation valve 48 side is connected to the stroke space 50*f* and an oil path 47*c* of the lowering oil path 47 on the tank 19 side is connected to the other side of the stroke space 50*f* opposite to such oil path 47*b*. The oil path 47*c* is disposed at a position corresponding to the connection portion 96, and is disposed at a position which does not interfere with the enlarged diameter portions 91, and 92 regardless of the reciprocating motion of the spool 90. The oil path 47*b* is disposed at a position corresponding to the connection portion 96 and the enlarged diameter portion 91, and is disposed at a position where the amount that is closed by the enlarged diameter portion 91 may be adjusted by the reciprocating motion (displacement) of the spool 90.

Figure 8B:
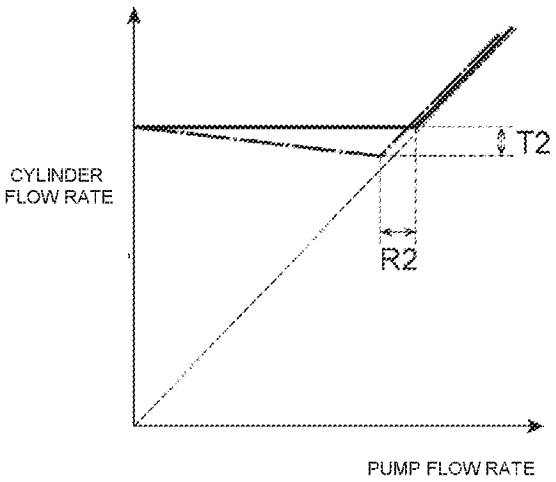
FIGS. 8A and 8B are charts showing a relation between a pump flow rate and a cylinder flow rate for a hydraulic drive device according to an embodiment and a comparative example.
Figure 8A:
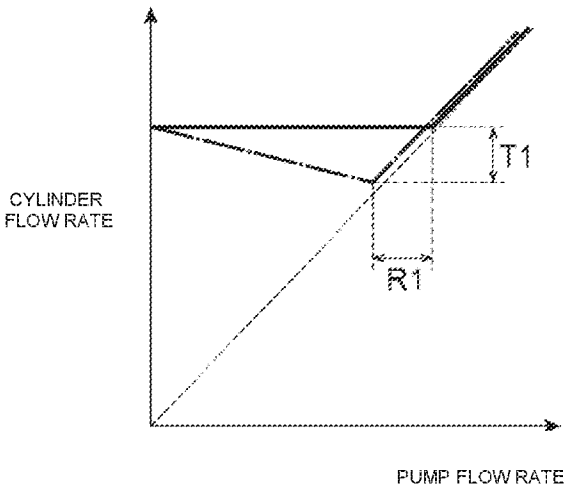
Figure 9B:
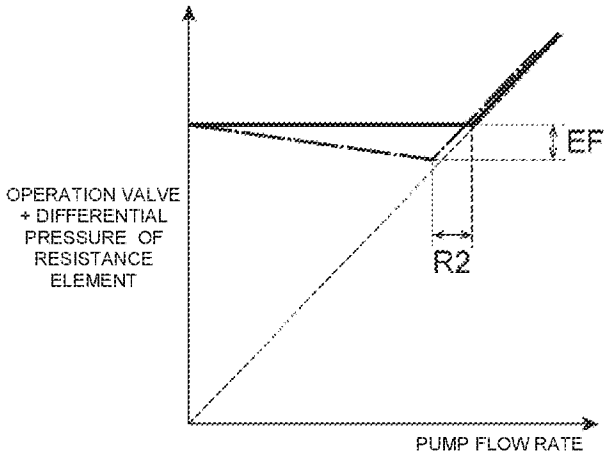
FIGS. 9A and 9B are charts showing a relation between a pump flow rate and a differential pressure for a hydraulic drive device according to an embodiment and a comparative example.
Figure 9A:
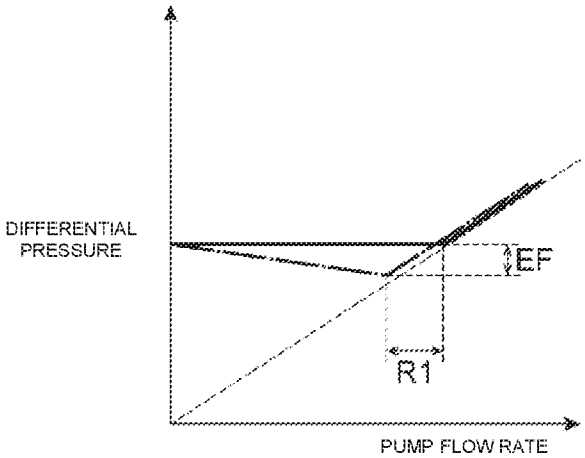

The effect of the bypass flow rate control valve 50 in the present embodiment will be described with reference to FIGS. 8A through 9B. FIGS. 8A and 9A are charts related to a hydraulic drive device according to a comparative example in which the resistance element 80 is not provided. FIGS. 8B and 9B are charts related to the hydraulic drive device 16 according to the present embodiment. The bypass flow rate control valve 50 adjusts the displacement of the spool 90 in accordance with the differential pressure generated by the operation valve 48, and as shown by the solid line in FIGS. 8A and 8B, the bypass flow rate control valve 50 acts so as to keep the cylinder flow rate constant even if the pump flow rate changes. Here, it is assumed that a disturbance such as a fluid force or a foreign object acts on the spool 90 and the cylinder flow rate deviates from the appropriate cylinder flow rate as indicated by a one-dot chain line in FIGS. 8A and 8B. In this case, when a disturbance force acts on the bypass flow rate control valve 50 and the cylinder flow rate falls below the appropriate cylinder flow rate, the force received from the right and left pressure receiving surfaces 91*a* and 92*a* of the spool 90 of the bypass flow rate control valve 50 is reduced by the value, that is, "the differential pressure of the control valve corresponding to the decreases a decrease in the cylinder flow rate×spool pressure receiving area". Such decrease in the force corresponds to the disturbance force. In FIG. 9A, the value obtained by multiplying the decrease amount EF due to the disturbance by the spool pressure receiving area corresponds to the disturbance force. At this time, the cylinder flow rate deviates until the disturbance force, the spring force of the spring 93 and the force due to the pilot pressure are balanced (FIG. 8A).

Now, in the case where the resistance element 80 is added as in the present embodiment and the pilot pressure of the bypass flow rate control valve 50 is obtained by the combination of "the differential pressure of operation valve and resistance element" will be considered. When the same disturbance force as that in the above description is applied, the cylinder flow rate deviates until the disturbance force, the spring force of the spring 93 and the force due to the pilot pressure are balanced. In the case of the present embodiment, since the flow rate per differential pressure is small, the amount of deviation is small, as compared with the comparative example. Specifically, as shown in FIG. 9B, even if the decrease amount EF of the differential pressure due to the disturbance is the same as that of the comparative example, the amount of fluctuation R2 of the pump flow rate corresponding to the decrease amount EF is smaller than the amount of fluctuation R1 of the comparative example. As shown in FIG. 8A, the amount of deviation T1 of the cylinder flow rate corresponding to the amount of fluctuation R1 increases, meanwhile the amount of deviation T2 of the cylinder flow rate corresponding to the amount of fluctuation R2 may become small because the amount of fluctuation R2 is small, as shown in FIG. 8B. According to the present embodiment, the influence of disturbance may be reduced, and the flow rate control characteristic may be stabilized. In addition, since it is not necessary to set a large differential pressure for the operation valve 48, efficiency is not impaired.

The following will describe the operation and the effect of the hydraulic drive device 16 of the cargo vehicle 1 according to the present embodiment.

The hydraulic drive device 16 of the cargo vehicle 1 according to the present embodiment includes the resistance element 80 disposed at a position that is closer to the lift cylinder 4 than the operation valve 48 in the lowering oil path 47 to increase the fluid resistance. Further, the pilot flow path 51 of the bypass flow rate control valve 50 is connected to the part of the lowering oil path 47 between the lift cylinder 4 and the resistance element 80. Such configuration permits adding the pressure loss generated by the resistance element 80 to the pilot pressure of the bypass flow rate control valve 50. Thus, as compared with the case where the pilot pressure is only provided by the pressure loss at the operation valve 48, the pilot pressure may be increased by adding the pressure loss of the resistance element 80. By increasing the pilot pressure in this manner, the influence of the disturbance, which makes the operation of the bypass flow rate control valve 50 unstable, may be reduced. Accordingly, the flow rate control characteristic of the hydraulic oil may be stabilized.

In addition, the hydraulic drive device 16 of the cargo vehicle 1 according to the present invention further includes the pilot check valve 81 for preventing natural fall disposed between the lift cylinder 4 and the operation valve 48 in the lowering oil path 47. The resistance element 80 is disposed between the pilot check valve 81 and the operation valve 48, and the merging position of the pilot flow path 82 of the pilot check valve 81 with the lowering oil path 47 is positioned closer to the operation valve 48 than the resistance element 80. This configuration permits reducing the pressure loss at the plunger 86 of the pilot check valve 81 by the influence of the pressure loss of the resistance element 80. Therefore, by adjusting the pressure loss of the resistance element 80, the total value of the pressure losses generated in the pilot check valve 81 and the resistance element 80 may be reduced. This permits improving energy recovery efficiency. Further, the resistance element 80 may be commonly used for obtaining such an effect and increasing the pilot pressure of the bypass flow rate control valve 50.

Although a preferred embodiment of the hydraulic drive device for the cargo vehicle according to the present invention has been described above, the present invention is not limited to the above embodiment.

For example, in the present invention, the pilot check valve 81 may be omitted as long as it includes a configuration that the pilot flow path of the bypass flow rate control valve is connected to a part of the lowering oil path between the hydraulic cylinder and the resistance element.

In the above-described embodiments, the tilt cylinder, the PS cylinder, and the attachment cylinder are provided as the second hydraulic cylinders. However, at least one cylinder is needed as the second hydraulic cylinder and part thereof may be omitted. For example, in the above embodiment, the attachment and the power steering are mounted, but the hydraulic drive device of the present invention is applicable to a forklift not equipped with the attachment and the power steering. Further, the hydraulic drive device of the present invention may be applied to any type of battery-operated cargo vehicle other than a forklift.

The electromagnetic proportional valve has been exemplified as the control valve that controls the flow of the hydraulic oil based on the lowering operation of the lift operation lever, and the control valve that controls the flow of the hydraulic oil based on the operation of the second operation member, but it may be of a hydraulic type or a mechanical type.

DESCRIPTION OF REFERENCE NUMERALS

1 cargo vehicle
4 lift cylinder (hydraulic cylinder)
4*b* bottom chamber
6 fork (object to be elevated)
11 lift operation lever (operation member)
16 hydraulic drive device
17 hydraulic pump motor (hydraulic pump)
17*a* suction port
17*b* discharge port
18 electric motor (motor)
47 lowering oil path
48 operation valve
49 hydraulic pipe (bypass oil path)
50 bypass flow rate control valve
51 pilot flow path
80 resistance element
81 pilot check valve

The invention claimed is:

1. A hydraulic drive device for a cargo vehicle, the hydraulic drive device comprising:

a hydraulic cylinder for raising and lowering that raises and lowers an object to be raised and lowered by supplying and discharging of hydraulic oil;

an operation member that operates the hydraulic cylinder;

a hydraulic pump that supplies and discharges the hydraulic oil to and from the hydraulic cylinder;

a lowering oil path connecting a bottom chamber of the hydraulic cylinder and a suction port of the hydraulic pump so that hydraulic oil discharged from the hydraulic cylinder flows to the suction port of the hydraulic pump;

an operation valve that is disposed in the lowering oil path and that controls a flow of hydraulic oil discharged from the hydraulic cylinder based on a lowering operation of the operation member;

a bypass oil path that branches off from the lowering oil path at a branch point and that connects the branch point and a tank that stores the hydraulic oil;

a bypass flow rate control valve that is disposed in the bypass oil path and that controls a bypass flow rate which is a flow rate of hydraulic oil flowing from the branch point to the tank; and a resistance element that is disposed closer to the hydraulic cylinder than the operation valve in the lowering oil path and that increases a fluid resistance, wherein a pilot flow path of the bypass flow rate control valve is connected to a part of the lowering oil path between the hydraulic cylinder and the resistance element, further comprising a pilot check valve for preventing natural fall, the pilot check valve being disposed between the hydraulic cylinder and the operation valve in the lowering oil path, wherein the resistance element is disposed between the pilot check valve and the operation valve, and a merging position of a pilot flow path of the pilot check valve with the lowering oil path is closer to the operation valve than the resistance element.

* * * * *